US006884041B2

(12) United States Patent
Boehland et al.

(10) Patent No.: US 6,884,041 B2
(45) Date of Patent: Apr. 26, 2005

(54) ELECTROMAGNETIC VALVE-CONTROLLED FUEL INJECTION PUMP FOR INTERNAL COMBUSTION ENGINES, ESPECIALLY DIESEL ENGINES

(75) Inventors: Peter Boehland, Marbach (DE); Andreas Sterr, Nuertingen (DE); Andreas Dutt, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 112 days.

(21) Appl. No.: 10/181,867

(22) PCT Filed: Nov. 16, 2001

(86) PCT No.: PCT/DE01/04319

§ 371 (c)(1),
(2), (4) Date: Nov. 8, 2002

(87) PCT Pub. No.: WO02/42634

PCT Pub. Date: May 30, 2002

(65) Prior Publication Data

US 2004/0131486 A1 Jul. 8, 2004

(30) Foreign Application Priority Data

Nov. 23, 2000 (DE) ..... 100 58 011

(51) Int. Cl.[7] ..... F02M 37/04; F04B 49/00

(52) U.S. Cl. ..... 417/297; 417/440; 417/505; 123/499; 251/337

(58) Field of Search ..... 417/278, 29.7, 417/440, 505; 123/490, 499, 514; 251/337, 129.15

(56) References Cited

U.S. PATENT DOCUMENTS

| | | | | |
|---|---|---|---|---|
| 5,318,001 A | | 6/1994 | Djordjevic | |
| 5,582,153 A | * | 12/1996 | Dutt et al. | 123/450 |
| 5,700,139 A | * | 12/1997 | Rodriguez-Amaya | 417/462 |
| 6,059,545 A | * | 5/2000 | Straub et al. | 417/505 |
| 6,280,160 B1 | * | 8/2001 | Nothdurft et al. | 417/462 |

FOREIGN PATENT DOCUMENTS

| | | |
|---|---|---|
| DE | 43 39 948 | 6/1995 |
| WO | WO 95 14857 | 6/1995 |
| WO | WO 97 40272 | 10/1997 |
| WO | WO 98 49441 | 11/1998 |

* cited by examiner

*Primary Examiner*—Charles G. Freay
(74) *Attorney, Agent, or Firm*—Kenyon & Kenyon

(57) ABSTRACT

A solenoid-valve-controlled fuel-injection pump for internal combustion engines, in particular diesel engines, has a solenoid valve, whose valve needle separates a high-pressure region from a low-pressure region, i.e. connects the high-pressure region and low-pressure region, in the pump housing, via a valve seat; the injection period being controlled by the opening of the solenoid valve. In addition, a low-pressure compensating piston situated in the low-pressure region is provided in order to compensate for pressure fluctuations in the low-pressure region. The exceptional feature is that the low-pressure compensating piston, which is positioned coaxially to the solenoid-valve needle, takes the form of a component part that is separate from the solenoid-valve needle. This ensures that the solenoid valve is opened unhindered and as rapidly as possible by the opening force exerted on the solenoid-valve needle by the electromagnet.

9 Claims, 2 Drawing Sheets

ELECTROMAGNETIC VALVE-CONTROLLED FUEL INJECTION PUMP FOR INTERNAL COMBUSTION ENGINES, ESPECIALLY DIESEL ENGINES

FIELD OF THE INVENTION

The present invention relates to a solenoid-valve-controlled fuel injection pump.

BACKGROUND INFORMATION

This principally relates to a so-called distributor-type fuel-injection pump. In the case of such solenoid-valve-controlled injection pumps that are preferably used in diesel engines, the injection period is controlled by the opening of the solenoid valve. In order that the diesel engine achieves good emission figures, the pressure in the line decreases as rapidly as possible. This can only be achieved by a quick-opening solenoid valve. Solenoid-valve-controlled pre-injection is only possible, using a quick-opening solenoid valve. Therefore, the solenoid valve is constructed in such manner, that its opening time can be reduced by hydraulic forces.

Particularly relevant to the present invention are those distributor-type fuel-injection pumps, in which a so-called I-solenoid valve is used. This type of valve construction distinguishes itself in that, in response to deactivation, the flow is radially directed from the outside to the inside. An opening (positive) force is achieved by diverting the flow in the low-pressure range. The force shortens the valve opening times.

A basic characteristic of the type of valve in question is a low-pressure surface, which is very large in comparison with the pressure-stage surface in the high-pressure region of the solenoid valve. Therefore, relatively large forces already occur in response to small pressure fluctuations in the low-pressure region. These forces cause fluctuations in the opening time, which result in deviations in the injection amount (from stroke to stroke). In order to at least partially compensate for the mentioned forces and thus largely prevent their disadvantageous effects, the valve type in question is provided with a low-pressure compensating piston, which interacts with the solenoid valve. Therefore, the low-pressure compensating piston has the function of producing stable opening characteristics of the solenoid valve. German Published Patent Application No. 4339948, whose subject matter is a fuel-injection pump of the species, belongs to the above-described related art. In the known fuel-injection pump, the low-pressure compensating piston is constructed in one piece with the solenoid-valve needle and positioned coaxially to it, it being practically a continuation of the solenoid-valve needle beyond the valve seat.

The disadvantage is that, upon terminating fuel delivery, flow is diverted on the low-pressure compensating piston. This diversion of the flow causes a pressure increase that creates a closing needle force. The disadvantageous effect is a delay in the opening of the solenoid valve during fuel-delivery termination.

The object of the present invention is to take appropriate measures to prevent unwanted delays in opening the solenoid valve.

SUMMARY OF THE INVENTION

The features according to the present invention succeed in retaining the advantages of the existing low-pressure compensating piston, which are important for the functioning of the solenoid valve in its closed state. However, the previous, negative effects of the low-pressure compensating piston during the opening of the solenoid valve are simultaneously eliminated.

DETAILED DESCRIPTION

Figure 1:
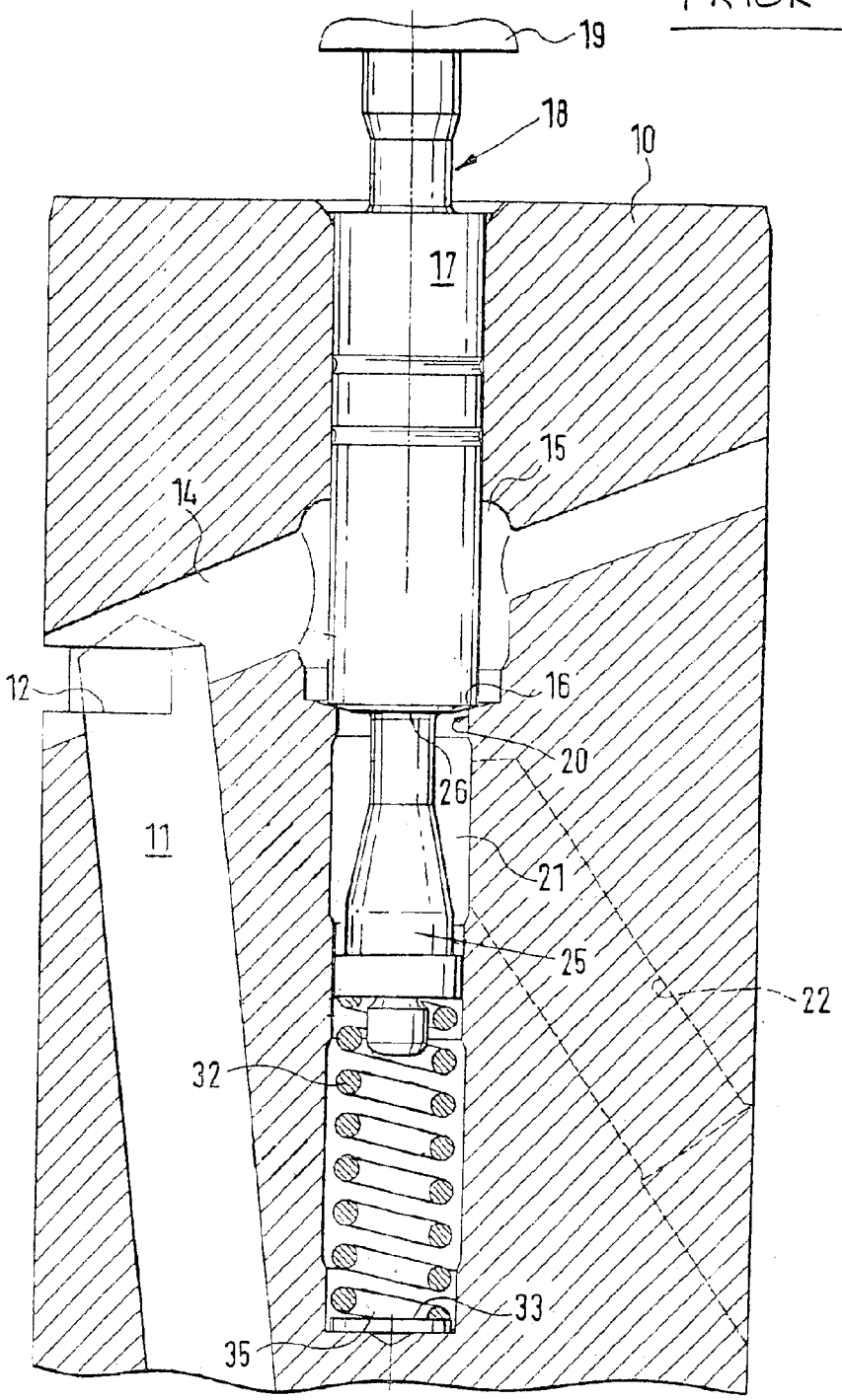
FIG. 1 PRIOR ART
FIG. 1 shows a vertical, longitudinal cross-sectional view of part of a distributor-type fuel-injection pump as found in the prior art.

FIG. 1 shows a vertical, longitudinal cross-sectional view of part of a distributor-type fuel-injection pump as found in the prior art. Reference numeral 10 designates a distributor, which is supported in a pump housing (not shown) in a manner that is well known and therefore not shown in detail. The actuation of distributor 10 is accomplished in a customary manner, which is why a detailed description of this may also be omitted.

A pump working chamber (not shown) is connected, via a pressure duct 11 in distributor 10, to a distributor groove 12, which is on the circumference of distributor 10, and from which the injection lines (not shown) running in the pump housing start out. The injection lines lead, in turn, to an injection valve (which is also not shown).

In addition, a connecting duct 14, which starts at the distributor groove 12 in the interior of distributor 10, empties into an annular groove 15. Annular groove 15 forms a valve seat 16 for a valve needle 17 of a solenoid valve (only partially shown), which is designated, as a whole, by reference numeral 18. An electromagnet, which actuates solenoid valve 18, is known related art, and therefore does not need to be represented in detail, is situated above solenoid-valve needle 17, at position 19.

Extending below valve seat 16 is a blind-end bore, which is specified as a whole by reference numeral 20 and has an expansion 21 from which a (further) connecting duct 22 starts out. Connecting duct 22 leads to a low-pressure part of the fuel-injection pump (not shown). Therefore, valve seat 16 and solenoid-valve needle 17 define a high-pressure region 14, 15 and a low-pressure region 21, inside distributor 10.

Positioned inside blind-end bore 20, coaxially to solenoid-valve needle 17 so as to be axially movable, is a low-pressure compensating piston 25, formed in one piece with solenoid-valve needle 17 at position 26.

Figure 2:
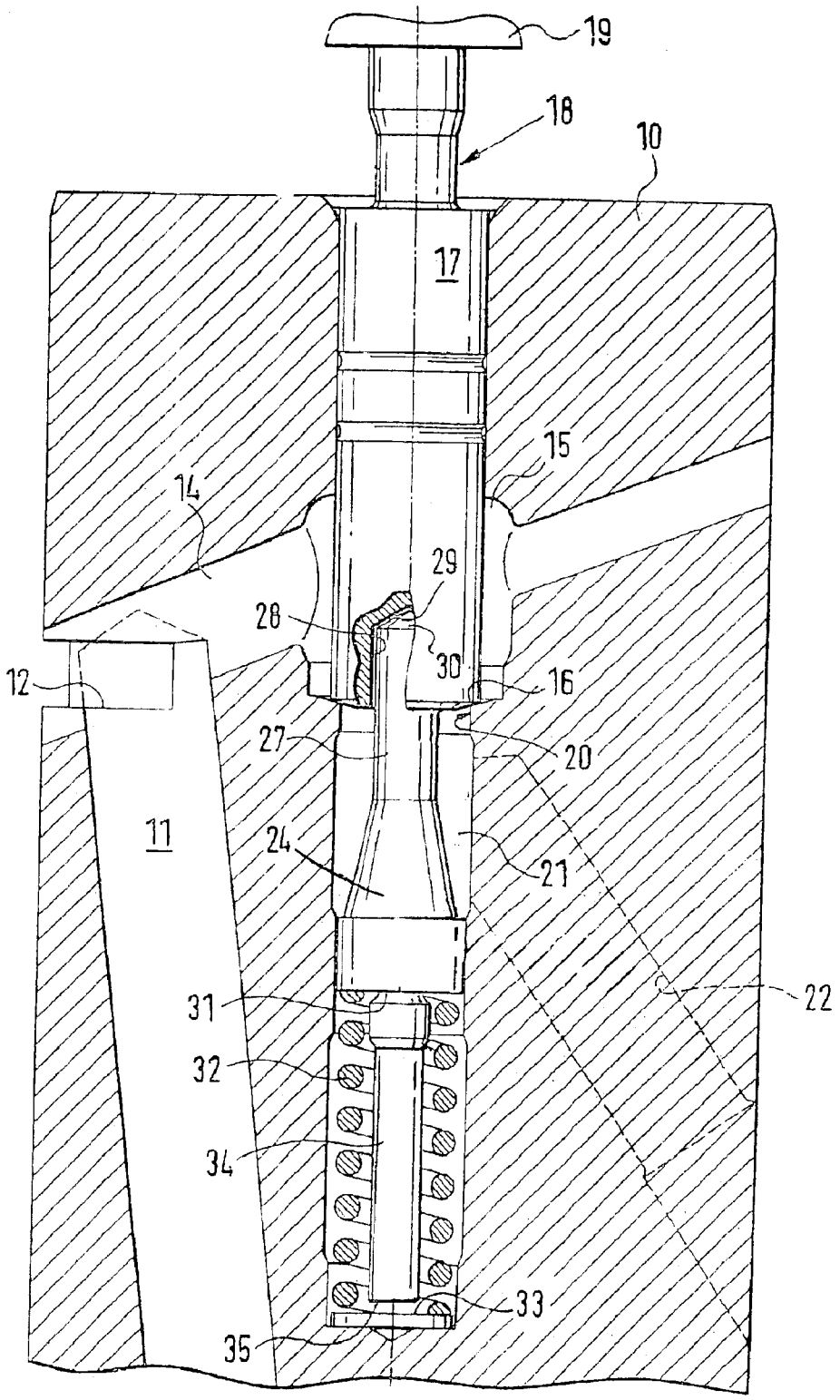
FIG. 2 illustrates a vertical, longitudinal cross-sectional view of part of a distributor-type fuel-injection pump according to an example embodiment of the present invention.

FIG. 2 illustrates a vertical, longitudinal cross-sectional view of part of a distributor-type fuel-injection pump according to a specific embodiment of the present invention. In contrast with the prior art shown in FIG 1, solenoid-valve needle 17 and low-pressure compensating piston 24 may take the form of two component parts, which are separate and, therefore, may be (axially) moved independently of each other. In order to guide low-pressure compensating piston 24, it has a piston rod 27 of reduced diameter, which engages with a cylindrical guide hole 28 introduced into solenoid-valve needle 17. The guidance 27/28 effectively prevents low-pressure compensating piston 24 from tilting (which would otherwise be possible). Cylindrical guide hole 28 takes the form of a blind-end bore, its (upper) end 29 acting as a limit stop that interacts with free end 30 of piston rod 27 of low-pressure compensating piston 24.

A compression spring (low-pressure compensating spring) 32, whose rear end is supported at the base 33 of blind-end bore 20, abuts against a rear end face 31 of low-pressure compensating piston 24. Low-pressure compensating spring 32 presses low-pressure compensating piston 24 against (upper) limit stop 29 of cylindrical guide hole 28.

A further exceptional feature is that a rod-shaped counter-stop 34, which is surrounded by low-pressure compensating spring 32, and whose end 35 interacts with the base 33 of blind-end bore 20 that simultaneously acts as the (lower) stroke-limit stop for low-pressure compensating piston 24, is situated at (lower) end face 31 of low-pressure compensating piston 24. At the same time, rod-shaped counter-stop 34 is also used to protect low-pressure compensating spring 32.

The described set-up and construction of low-pressure compensating piston 24 takes effect during the operation of the fuel-injection pump as follows.

Upon opening solenoid valve 18, the pressure in high-pressure region 14, 15 is reduced via valve seat 16. This results in a local increase in pressure on solenoid-valve needle 17 and low-pressure compensating piston 24. Low-pressure compensating piston 24 now separates from solenoid-valve needle 17. The force of the low-pressure compensating piston, which is aligned in the closing direction, is supported at distributor housing 10, via stroke-limit stop 33, 34, 35. The force of the solenoid valve results in solenoid valve 18 opening quickly.

The hydraulic forces exerted on low-pressure compensating piston 24, which, in the case of the previous one-piece construction of the solenoid-valve needle and low-pressure compensating piston, disadvantageously act in the closing direction of the solenoid-valve needle, are eliminated by the present invention's separate construction of solenoid-valve needle 17 on one side and low-pressure compensating piston 24 on the other side. Therefore, the opening force exerted by electromagnet 19 on solenoid-valve needle 17 has the desirable effect of opening solenoid valve 18 unhindered and thus as rapidly as possible.

What is claimed is:

1. A solenoid-valve-controlled fuel-injection pump for an internal combustion engine, comprising:

a high-pressure region;

a low-pressure region;

a low-pressure compensating piston arranged in the low-pressure region in order to compensate for pressure fluctuations in the low-pressure region;

a valve seat; and a solenoid valve including a valve needle that separates the high-pressure region from the low-pressure region and connects the high-pressure region and the low-pressure region in a pump housing, via the valve seat, wherein:

an injection period is controlled by an opening of the solenoid valve, and the low-pressure compensating piston is positioned coaxially to the valve needle and includes a component part that is separate from the valve needle, wherein the low-pressure compensating piston is configured to compensate for pressure fluctuations in the low-pressure region by exerting a force on the solenoid valve.

2. The solenoid-valve-controlled fuel-injection pump according to claim 1, wherein:

the internal combustion engine includes a diesel engine.

3. A solenoid-valve-controlled fuel-injection pump for an internal combustion engine, comprising:

a high-pressure region;

a low-pressure region;

a low-pressure compensating piston arranged in the low-pressure region in order to compensate for pressure fluctuations in the low-pressure region;

a valve seat;

a solenoid valve including a valve needle that separates the high-pressure region from the low-pressure region and connects the high-pressure region and the low-pressure region in a pump housing, via the valve seat, wherein:

an injection period is controlled by an opening of the solenoid valve, and the low-pressure compensating piston is positioned coaxially to the valve needle and includes a component part that is separate from the valve needle;

a low-pressure compensating spring; and a stroke-limit stop for the low-pressure compensating piston provided on a rear end of a low-pressure compensating piston chamber opposite to the valve needle, the low-pressure compensating piston chamber being coaxially contiguous to the low-pressure region in the pump housing, and the stroke-limit stop protecting the low-pressure compensating spring, wherein:

in the low-pressure compensating piston chamber, the low-pressure compensating piston is positioned so as to be axially movable in opposition to a resistance of the low-pressure compensating spring acting on a back side of the low-pressure compensating piston.

4. The solenoid-valve-controlled fuel-injection pump according to claim 3, further comprising:

a counter-stop that interacts with the stroke-limit stop and has a diameter that is narrower than a diameter of the low-pressure compensating piston, the counter-stop being situated at a rear face of the low-pressure compensating piston opposite to the valve needle.

5. The solenoid-valve-controlled fuel-injection pump according to claim 4, wherein:

the low-pressure compensating piston is guided in the low-pressure compensating piston chamber independently of the valve needle.

6. The solenoid-valve-controlled fuel-injection pump according to claim 5, wherein:

the low-pressure compensating piston is axially supported in the pump housing by the stroke-limit stop and the counter-stop.

7. The solenoid-valve-controlled fuel-injection pump according to claim 3, wherein:

when the solenoid valve is closed, a force of the low-pressure compensating spring causes a piston rod of the low-pressure compensating piston to abut against the stroke-limit stop in a cylindrical guide hole.

8. A solenoid-valve-controlled fuel-injection pump for an internal combustion engine, comprising:

a high-pressure region;

a low-pressure region;

a low-pressure compensating piston arranged in the low-pressure region in order to compensate for pressure fluctuations in the low-pressure region;

a valve seat; and a solenoid valve including a valve needle that separates the high-pressure region from the low-pressure region and connects the high-pressure region and the low-pressure region in a pump housing, via the valve seat, wherein:

an injection period is controlled by an opening of the solenoid valve;

the low-pressure compensating piston is positioned coaxially to the valve needle and includes a component part that is separate from the valve needle; and an end of the low-pressure compensating piston facing the solenoid valve includes a piston rod that extends into a cylindrical guide hole introduced into the valve needle in a region of the valve seat, the piston rod guiding the low-pressure compensating piston.

9. The solenoid-valve-controlled fuel-injection pump according to claim 8, wherein:

the cylindrical guide hole includes a limit stop for the piston rod and the low-pressure compensating piston.

* * * * *